United States Patent [19]

Alexander

[11] Patent Number: 4,610,135

[45] Date of Patent: Sep. 9, 1986

[54] COMBUSTION EQUIPMENT FOR A GAS TURBINE ENGINE

[75] Inventor: Eric A. Alexander, Aston-on-Trent, England

[73] Assignee: Rolls-Royce plc, London, England

[21] Appl. No.: 325,310

[22] Filed: Nov. 23, 1981

[30] Foreign Application Priority Data

Dec. 10, 1980 [GB] United Kingdom ..... 8039143

[51] Int. Cl.[4] ..... F02C 1/00

[52] U.S. Cl. ..... 60/39.01; 60/723; 60/733; 60/737; 60/738; 60/746; 60/750

[58] Field of Search ..... 60/723, 733, 737, 738, 60/746, 750, 39.01

[56] References Cited

U.S. PATENT DOCUMENTS

| | | | |
|---|---|---|---|
| 3,879,939 | 4/1975 | Markowski | 60/746 |
| 4,062,182 | 12/1977 | Fehler et al. | 60/737 |
| 4,118,171 | 10/1978 | Flanagan et al. | 60/723 |
| 4,168,609 | 9/1979 | Greenberg et al. | 60/746 |
| 4,173,118 | 11/1979 | Kanaguchi | 60/733 |
| 4,271,674 | 6/1981 | Marshall et al. | 60/737 |
| 4,374,466 | 2/1983 | Sotheran | 60/738 |

FOREIGN PATENT DOCUMENTS

| | | |
|---|---|---|
| 1397296 | 6/1975 | United Kingdom . |
| 2034874 | 11/1978 | United Kingdom . |
| 2044912 | 10/1980 | United Kingdom . |

*Primary Examiner*—Donald P. Walsh
*Attorney, Agent, or Firm*—Cushman, Darby & Cushman

[57] ABSTRACT

Combustion equipment for a gas turbine engine operating on the pre-mix lean combustion bases comprises a flame tube having a plurality of alternately arranged main and pilot air ducts each having a respective fuel injector and receiving axially directed air from downstream of part span outlet guide vanes. The fuel and air in each duct are substantially pre-mixed before entry into the flame tube and the outlets of the pilot ducts direct the fuel and air mixture into the recirculation zone in a single vortex. At engine idle the air fuel ratio (AFR) is substantially stoichiometric to prevent the formation of unburnt hydrocarbons (UHC) and carbon monoxide (CO). As the engine accelerates the fuel flow to the pilot air ducts remains near constant so that the AFR in the re-circulation zone progressively weakens, and fuel is introduced into the main air ducts, the outlets of which direct the air fuel mixture into the flame tube with a substantial downstream component. The equivalence ratio of the main air fuel mixture is kept below 0.7 to keep NOx emissions at an acceptable level.

Air direct from the engine compressor with a large swirl component is used to cool the flame tube walls with a high degree of effectiveness due to the scrubbing action of the air.

Ducting for outer dilution air and bleed air can also be provided interdigitated with the main and pilot air ducting, and the flame tube can also have a catalyst block which allows the re-circulation zone to run weak at engine idle without excessive UHC and CO being produced.

8 Claims, 11 Drawing Figures

COMBUSTION EQUIPMENT FOR A GAS TURBINE ENGINE

Figure 1:
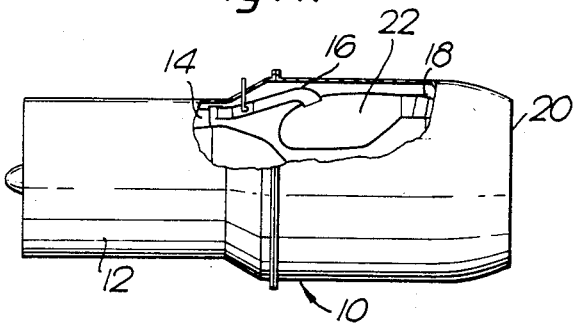

This invention relates to combustion equipment for a gas turbine engine and is concerned with reducing the quantities of emissions including, nitrogen oxides ($NO_x$) produced in such combustion equipment to an acceptable level and with adequately cooling the combustion equipment.

The air supply to combustion equipment which may comprise a single annular flame tube or a number of separate generally cylindrical flame tubes can be divided into primary air, secondary air, dilution air and cooling air. The primary air which is usually introduced upstream of the combustion zone provides the greater part of the air required for combustion and the fuel is usually introduced into the flame tube independently of the primary air at the head of the flame tube. The secondary air when used is introduced downstream of the combustion zone to complete the combustion and possibly also to assist the combustion gases to undergo reversals of direction. The dilution air is introduced downstream of the secondary air to mix with the combustion gases and reduce their temperature to a value suitable for the turbine of the engine. The cooling air, as the name implies is a quantity of air provided to cool the walls of the flame tube and keep the walls at an acceptable temperature.

As a practical matter, the primary and secondary air can be considered as the total combustion air which can be injected into the flame tube at the same or closely adjacent locations. A method of injecting combustion air in this way is shown in our U.K. patent specification No. 1035541 in which the primary and secondary air are injected through adjacent ducts and the fuel is injected into the primary air immediately upstream of its entry into the flame tube. These two air flows, now united to provide the combustion air, are injected transversely of the flame tube so that a single vortex of fuel and air is created in the combustion zone. The dilution air is also injected transversely of the flame tube downstream of the combustion zone from the same side as the combustion air and forms a barrier to prevent any unburnt fuel from leaving the combustion zone. The effect of the vortex is to ensure adequate mixing of the fuel and air and consequent efficient combustion of the mixture within a relatively short combustion zone. Such an arrangement has the advantage of being capable of reducing the emissions of $NO_x$ from the engine, but due to the transverse injection of the combustion and dilution air, difficulties may be experienced in cooling the flame tube, particularly the head of the flame tube.

The present invention seeks to provide combustion equipment similar to that shown in our UK patent specification No. 1035541, but improved to assist in the reduction of $NO_x$ and other emissions and to adequately cool the flame tube.

Accordingly the present invention provides combustion equipment for a gas turbine engine, the combustion equipment including a flame tube located in an air casing, the air casing being divided into two regions, both arranged to receive air from the compressor of the engine, one of said regions including air having adjacent its upstream end flow directing means to direct compressed air axially into said ducting, the air ducting including combustion air ducting having fuel injector means, the downstream end of at least some of the combustion air ducting being directed transversely of the flame tube, the fuel injector means being located in the combustion air ducting upstream of the entry into the flame tube, whereby the fuel and combustion air are at least partially mixed before entry into the flame tube, the other one of said regions comprising cooling air ducting arranged to receive air having a swirl component from the engine compressor, part of the cooling air duct comprising at least a part of the upstream end of the flame tube.

The combustion air ducting may comprise alternate main and pilot air ducts each having a fuel injector located adjacent the entry of each of said ducts, so that the fuel and air in each said duct can be mixed to a substantial degree before entry into the flame tube.

The pilot combustion air can enter the flame tube transversely from one side only of the flame tube to create a single vortex of fuel and air in the combustion zone.

The air ducting may also include dilution air ducting and bleed air ducting from which air can be tapped for various purposes, e.g. cabin air.

The air ducting may be defined by two walls, one of which separates the two regions of the air casing and the alternately arranged spaced apart main and pilot combustion air ducts, the spaces between the combustion air ducts defining the dilution air ducting and the bleed air ducting.

Guide vanes may be located between the two walls at the upstream end of the walls to straighten the swirling flow of air from the engine compressor so that the air enters the air casing in a substantially axial direction.

The upstream end of the air casing and the guide vanes may be located in the annulus downstream of the engine compressor and only partially span the annulus, so that swirling compressor delivery air enters the cooling air ducting and is directed over at least part of the head of the flame tube.

Some of the cooling air may also be used to cool the engine turbine, and the used cooling air may also be used as dilution air which enters the flame tube on the opposite side to that which the dilution air from the dilution air ducting enters.

One of the walls of the annulus may at least comprise part of one of the walls defining the air casing, or the upstream end of the two walls with the guide vanes located between the two walls can be located between the walls defining the annulus, so that swirling air from the compressor flows over the exterior of both of the walls. In this case dilution and bleed air ducting can be omitted from the air ducting and bleed air can be tapped from the swirling air flow.

Figure 3:
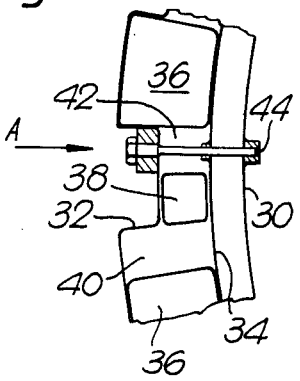
Figure 2:
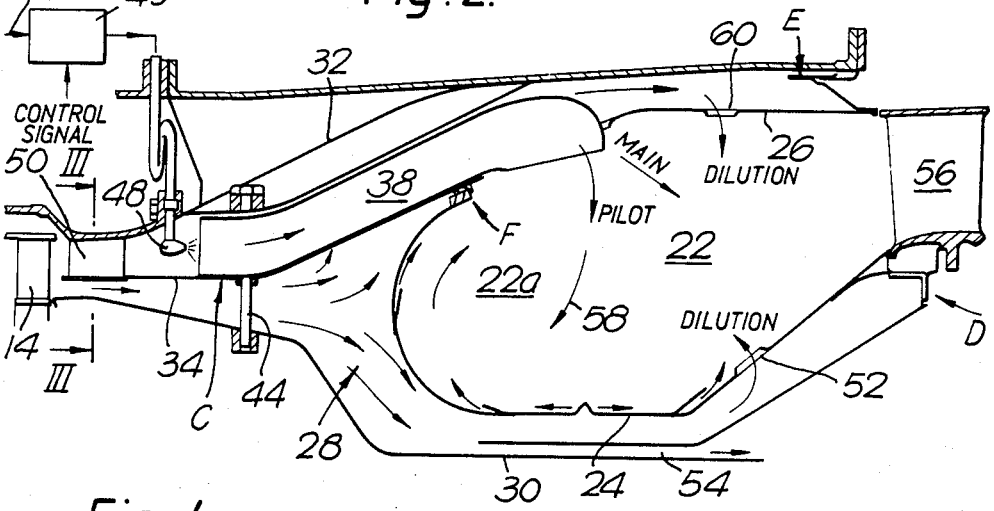
Figure 4:
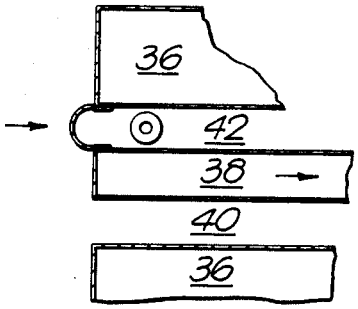
Figure 5:
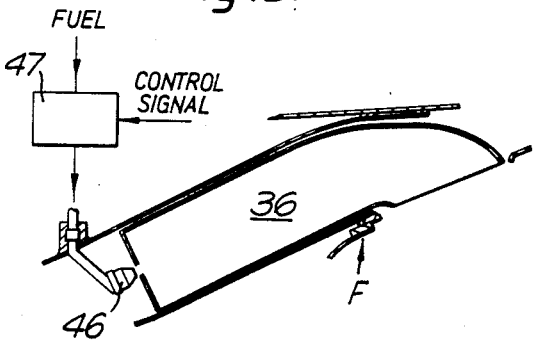
Figure 6:
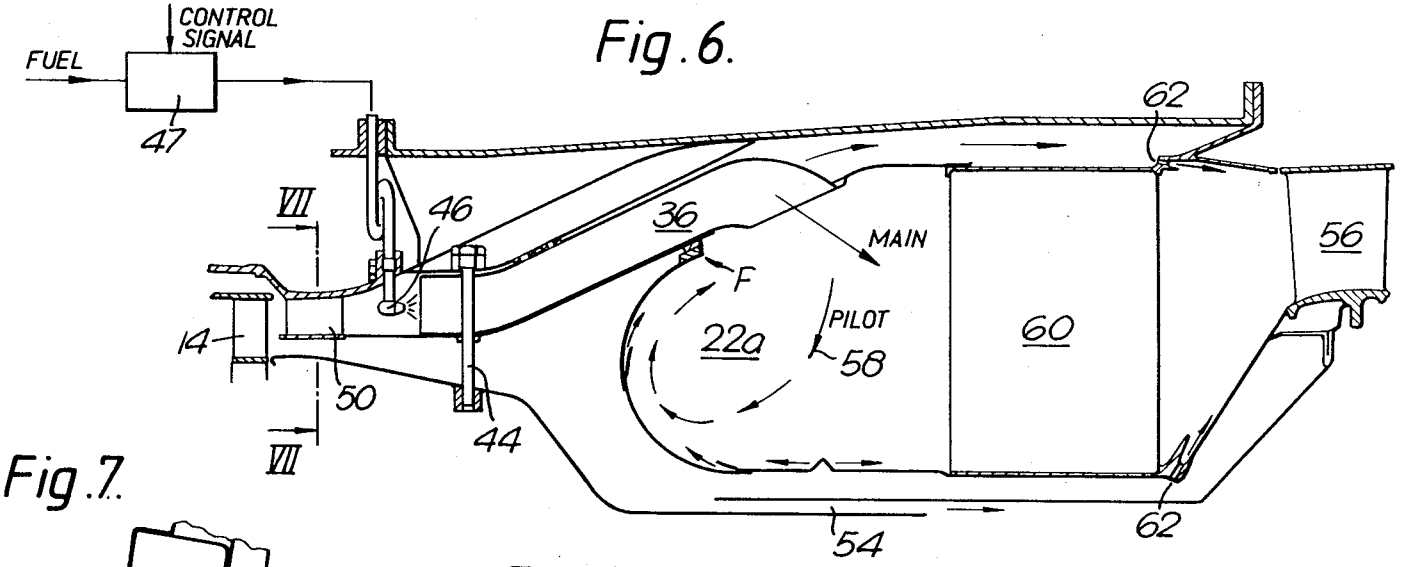
Figure 9:
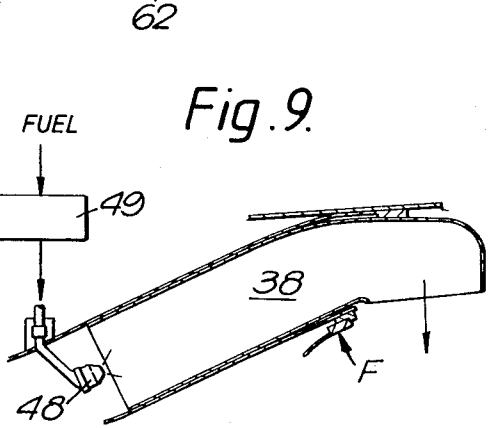
Figure 8:
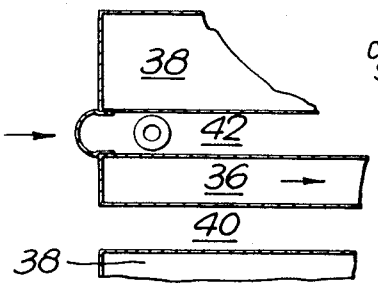
Figure 7:
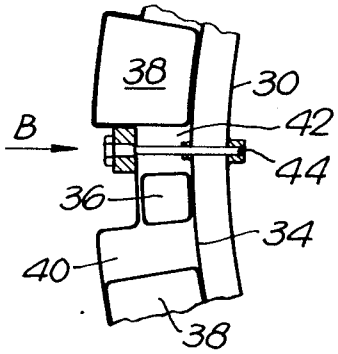
Figure 10:
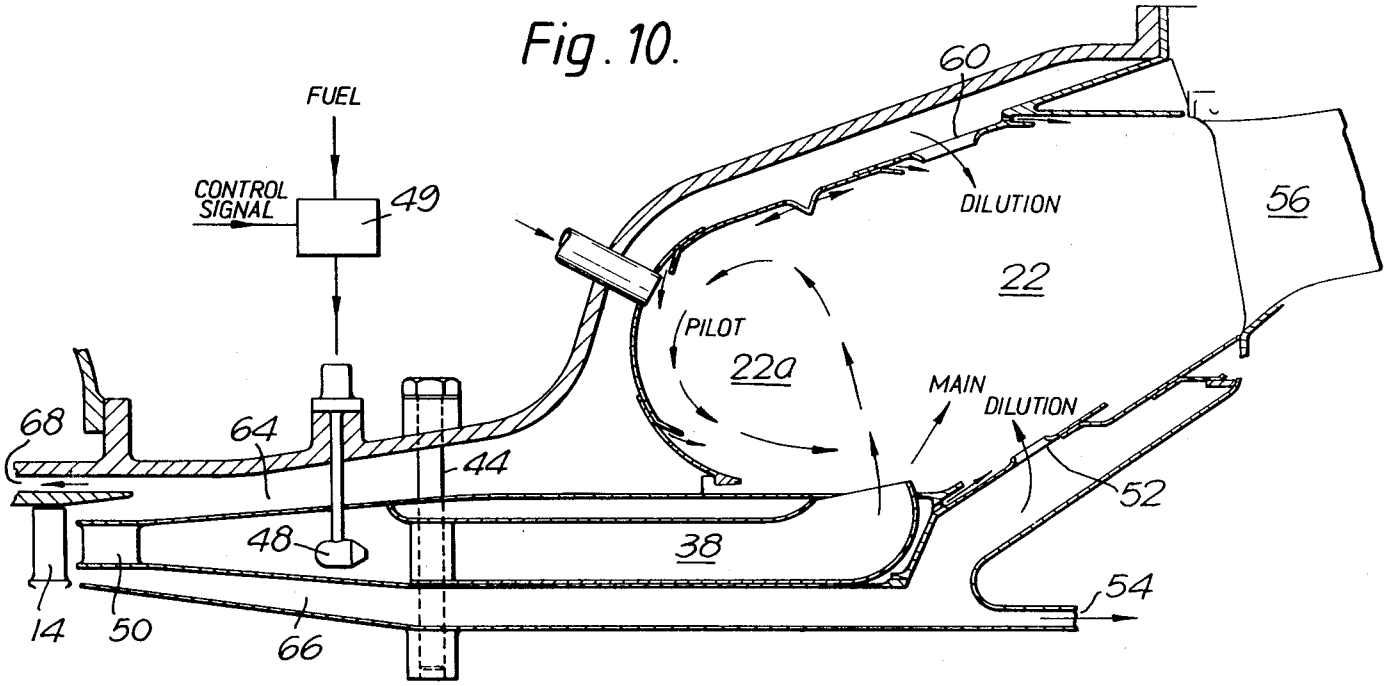
Figure 11:
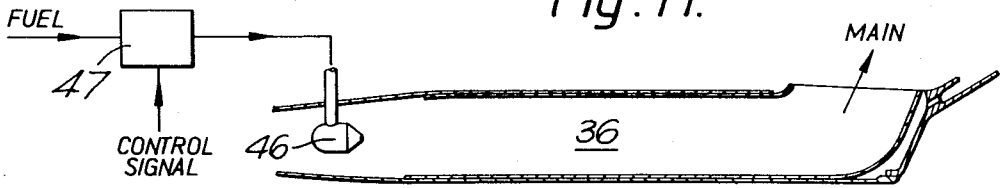

The present invention will now be more particularly described with reference to the accompanying drawings in which, FIG. 1 shows a gas turbine engine having one form of combustion equipment according to the present invention, FIG. 2 is an elevation of the combustion equipment shown in FIG. 1, to a larger scale, FIG. 3 is a part-section on line 3—3 in FIG. 2, FIG. 4 is a view on arrow 'A' in FIG. 3, FIG. 5 is an elevation of a main fuel and air duct which forms part of the combustion equipment shown in FIG. 2, FIG. 6 is an elevation of a modified form of combustion equipment according to the present invention, FIG. 7 is a part section on line 7—7 in FIG. 6, FIG. 8 is a view on arrow 'B' in FIG. 7, FIG. 9 is an elevation of a pilot fuel and air duct, which forms part of the combustion equipment shown in FIG. 6, FIG. 10 is an elevation of another form of combustion equipment according to the present invention and, FIG. 11 is an elevation of a main fuel and air duct which forms part of the combustion equipment shown in FIG. 10.

Referring to the drawings, in particular FIGS. 1 to 5 inclusive, a gas turbine engine 10 comprises a casing 12 in which there is disposed in axial flow series, a compressor 14, combustion equipment 16, a turbine 18 and an exhaust nozzle 20.

The combustion equipment 16 comprises an annular flame tube 22 having internal and external walls 24 and 26, respectively. The flame tube 22 is disposed in air casing 28 defined by internal and external walls 30 and 32 respectively.

The air casing is divided into two regions, the outer one of which includes air ducting which is defined by the external wall 32, a partition 34, main and pilot air ducts 36, 38 respectively, a dilution air duct 40 and a bleed air duct 42 which provides cabin air and air for other purposes if required. The internal wall 30 is attached to the air ducting by a number of support pins 44 which pass through the bleed air duct 42 and thus do not interfere with the air flow through the main and pilot air ducts 36, 38.

The air ducting is attached to the outer casing of the engine, the partition 34 of the air ducting being in two parts with a sliding joint between the two parts at C. The flame tube 22 is secured at its downstream end rigidly at D and slidingly at E, a location between the flame tube and the air ducting also being provided at F which allows differential radial and axial movement. The pilot air ducts 38 are directed transversely of the flame tube with little or no downstream component (see FIG. 2) whilst the main air ducts are directed with a substantial downstream component (see FIG. 5).

Each of the main and pilot air ducts 36, 38 have a fuel injector 46, 48 respectively which is located at the upstream end of the respective air duct so that the fuel and air are pre-mixed to a considerable extent before entering the flame tube 22. The fuel flow to the fuel injectors is independent and separately controlled by control systems 47 and 49. The upstream end of the air ducting only partially spans the annulus downstream of the compressor 14 and includes a number of angularly arranged outlet guide vanes 50 provided to remove the swirl component from the compressor delivery air so that the air entering the air ducting does so in a substantially axial direction. The remaining compressor delivery air, which still has a swirl component enters the inner region which includes cooling air ducting defined by the internal wall 30 and the partition 34. This swirling cooling air is used principally to cool the head of the flame tube 22 after which it is injected into the flame tube as dilution air through dilution air holes 52. A small proportion of the cooling air can be tapped off through a duct 54 and used to cool downstream engine components, such as the nozzle guide vanes 56 or the turbine 18.

At low engine pressure conditions e.g. at idle and up to about 30% of maximum engine R.P.M, fuel is supplied only to the pilot or primary air ducts. The fuel and air in these ducts are pre-mixed to a considerable degree and some fuel vaporization also occurs and because of the alignment of the pilot air ducts, the fuel and air mixture forms a single recirculation vortex 58 in the re-circulation zone 22*a* of the flame tube. The pilot air ducts and the recirculation zone are sized to give a residence time sufficient to give satisfactory combustion efficiency at idle. The air fuel ratio (AFR) at idle is approximately stoichiometric giving an equivalence ratio of about unity, equivalence ratio being defined as the ratio between the stoichiometric AFR and the actual AFR. Since the AFR at idle is stoichiometric, substantially all the fuel will be burnt in the recirculation reducing unburnt hydro-carbons (UHC) and carbon monoxide (10) emissions to a minimum.

As the engine accelerates fuel is also introduced into the main or secondary air ducts 36, leaving the fuel flow to the pilot air ducts 38 substantially constant. Since the mass flow of air through the pilot air tubes will increase, the AFR in the recirculation zone will continue to weaken, thereby reducing the temperature in the re-circulating zone thereby offsetting the effect of the increasing compressor exit temperature on the combustor wall temperatures.

The fuel and air in the main air ducting 36 is also substantially pre-mixed together with a degree of fuel vapourisation before being injected into the flame tube 22 with a substantial downstream component. The combustion gases and unburnt fuel, if any, from the re-circulation zone will be entrained into the main fuel and air flow which has an equivalence ratio of 0.7 or less in order to ensure an acceptable level of $NO_x$ emission at high pressures and temperatures, and to minimize flame radiation so that the flame tube wall cooling requirement can be kept to a minimum.

The reaction time of the main fuel and air flow must not be too short or incomplete combustion at the lower end of the operating range will occur, whilst excessive reaction time will result in high $NO_x$ emissions at the higher pressure conditions. To control this reaction time the outer dilution air from the ducts 40 enters the flame tube through inlets 60, whilst the inner dilution air enters the flame tube through the inlets 52. The number, sizing and location of the dilution air inlets are chosen to achieve an acceptable reaction time of the main fuel and air flow.

As mentioned above, because of the lack of guide vanes at the entry of the cooling air ducting, the cooling air has a high swirl component. The annulus area of the cooling air ducting increases in the downstream direction, which causes a reduction in the axial velocity of the cooling air and also an increase in swirl angle of the cooling air. Thus the cooling air has the potential for a high rate of heat removal from the flame tube walls, because of the scrubbing action of the cooling air as compared with a purely axial flow. Thus economies in the use of cooling air can be achieved and/or the flame tube can be more effectively cooled allowing higher combustion temperature, if required. To avoid local hot spots, the flame tube should be as clean as possible, e.g. external protuberances should be avoided and in the present invention these are avoided by placing the fuel injectors in the main and pilot air ducting whilst the igniters (not shown) are located in the bleed air tube.

It will be appreciated that the combustion equipment of the present invention operates on a pre-mix lean combustion basis which offers a number of advantages:

(a) A reduction in $NO_x$ emissions, (b) A reduction in flame radiation, (c) A lack of smoke which is usually formed at equivalence ratios greater than unity in conventional designs, (d) Little likelihood of carbon formation in the flame tube because of the lack of UHC (e) Pre-mixing the fuel and air before entering the combustor reduces the difficulty of achieving an even exit temperature distribution and (f) As compared with conventional designs, pre-mixed combustors may have superior combustion efficiency and stability.

This type of design is not without its problems, such as the fuel and air mixtures must be virtually homogeneous, the fuel injectors must be insensitive to fuel gumming, flash-back and auto-ignition must be avoided and relatively large quantities of air are needed for combustion, but these problems can be overcome by judicious design.

The arrangement shown in FIGS. 6 to 9 is similar to that previously described and similar components have been given the same reference numbers.

In this embodiment, the flame tube includes a catalyst block 60, such as a platinum coated metal or ceramic monolith, which causes a fuel reaction between 1200° and 1600° C. Thus all the fuel is burnt on the catalyst block, and the combustion efficiency at idle is not important, the UHC and CO being consumed by the action of the catalyst. The pilot fuel and air can therefore be weak and the roles of the ducts 36, 38 are reversed as compared with the previous embodiment. The flow proportion passing through the ducts of this design is greater than that of the previous design and so dilution is no longer required, the only air passing round the block being for discharge nozzle cooling.

At some stage during engine acceleration, fuel is diverted from the pilot supply into the main or smaller ducts. At this stage, the mixture strength of the gases leaving both duct types is too weak to maintain combustion within the main zone and the flame will extinguish leaving the entire reaction to take place inside the catalyst structure. This type of combustion will result in virtually no formation of nitrogen oxides.

During deceleration, automatic actuation of the ignition system on main fuel shut down must be incorporated if flashback from the catalyst structure is found to be an inadequate ignition source for the recirculation zone flame.

In the embodiment shown in FIGS. 10 and 11, the flame tube is arranged externally of the air ducting which now only comprises alternately arranged main and pilot air ducts 36, 38 with their respective fuel injectors 46, 48, the dilution and bleed air ducting having been dispensed with. This embodiment functions in the same manner as described with reference to FIGS. 1 to 5 except that both the inner and outer dilution flows are derived from swirling compressor delivery air, which also performs the function of cooling the flame tube. This is achieved by having the upstream end of the air ducting and the outlet guide vanes 50 not only partially spanning the annulus downstream of the compressor 14 but also centrally positioned in the annulus. This arrangement provides two cooling air ducts 64, 66, one on each side of the air ducting. The cabin air is now tapped from the flow downstream of the compressor 14 into an annulus 68.

I claim:

1. Combustion equipment downstream of a compressor of a gas turbine engine, said combustion equipment comprising:

a flame tube;

an air casing in which said flame tube is located, said air casing being divided into two separate regions, each of said regions arranged to receive compressed air from said compressor of said gas turbine engine;

air ducting in one of said regions, said air ducting including angularly arranged pilot air ducts having pilot fuel injectors in upstream ends thereof alternating with angularly arranged main air ducts having main fuel injectors in upstream ends thereof, said pilot air ducts having downstream ends with outlets opening into said flame tube and arranged to direct a fuel/air mixture transversely into said flame tube to form a single recirculation vortex in a recirculation zone, said main air ducts having downstream ends with outlets opening into said flame tube and arranged to direct a fuel/air mixture into said flame tube with a substantial component of direction downstream of said flame tube;

flow directing means immediately upstream of said air ducting to direct air substantially axially into said air ducting;

and cooling air ducting in the other of said regions of said air casing, said cooling air ducting being arranged to receive compressed air having a swirl component from said compressor, said cooling air ducting including at least a part of the upstream end of said flame tube.

2. Combustion equipment as claimed in claim 1 in which the air ducting includes dilution air ducting and bleed air ducting alternately arranged with the pilot and main air ducts.

3. Combustion equipment as claimed in claim 1 in which fuel supply to the pilot fuel injectors in the pilot air ducts is controlled by a pilot fuel control and fuel supply to the main fuel injectors in the main air ducts is controlled by a main fuel control, the pilot fuel control being arranged to supply fuel at a substantially constant rate throughout the operating range of the engine, the air fuel ratio in the flame tube re-circulation zone being substantially stoichiometric at the engine idle condition, and the main fuel control being arranged to supply at a rate to ensure that the equivalence ratio of the fuel and air mixture from the main air ducts remains below 0.7.

4. Combustion equipment as claimed in claim 1 in which the flame tube includes a catalytic igniter, and the fuel supply to the pilot fuel injectors means in the pilot air ducts is controlled by a pilot fuel control to supply fuel at a substantially constant rate throughout the engine operating range, the air fuel ratio at the engine idle condition being stoichiometric or weaker.

5. Combustion equipment as claimed in claim 1 in which the flow directing means comprise a plurality of angularly disposed guide vanes disposed in an annulus downstream of the engine compressor, the guide vanes having a span less than the annulus width.

6. Combustion equipment as claimed in claim 5 in which the guide vanes extend from the outer wall of the annulus, and span the inlet to the air ducting.

7. Combustion equipment as claimed in claim 6 in which the guide vanes are centrally disposed in the annulus and span the inlet to the air ducting.

8. Combustion equipment as claimed in claim 1 in the cooling air ducting receives air direct from the last rotating stage of the engine compressor, and the cooling air ducting is annular in cross-section and the annulus increases in cross-sectional area in the downstream direction.

* * * * *